US007924227B2

(12) United States Patent
Yamada

(10) Patent No.: US 7,924,227 B2
(45) Date of Patent: Apr. 12, 2011

(54) WIRELESS COMMUNICATION DEVICE

(75) Inventor: Atsushi Yamada, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 118 days.

(21) Appl. No.: 11/833,144

(22) Filed: Aug. 2, 2007

(65) Prior Publication Data

US 2008/0068269 A1 Mar. 20, 2008

(30) Foreign Application Priority Data

Sep. 15, 2006 (JP) ..... 2006-251754

(51) Int. Cl.
*H01Q 9/04* (2006.01)
*H01Q 1/38* (2006.01)

(52) U.S. Cl. ..... 343/700 MS; 343/841; 343/846; 343/848

(58) Field of Classification Search ..... 343/700 MS, 343/778–790, 702, 791, 846, 841, 848
See application file for complete search history.

(56) References Cited

U.S. PATENT DOCUMENTS

| | | | | |
|---|---|---|---|---|
| 5,444,452 | A * | 8/1995 | Itoh et al. | 343/700 MS |
| 6,262,495 | B1 | 7/2001 | Yablonovitch et al. | |
| 7,009,563 | B2 * | 3/2006 | Mori et al. | 343/700 MS |
| 7,227,502 | B2 * | 6/2007 | Yamamoto | 343/700 MS |
| 7,310,061 | B2 * | 12/2007 | Nagasaku et al. | 342/104 |
| 7,346,679 | B2 * | 3/2008 | Padmanabhan et al. | 709/224 |
| 7,372,149 | B2 * | 5/2008 | Yamamoto et al. | 257/728 |
| 7,436,679 | B2 * | 10/2008 | Iijima et al. | 361/760 |
| 2003/0169199 | A1 | 9/2003 | Kondo | |
| 2003/0184480 | A1 | 10/2003 | Shibata | |
| 2007/0080864 | A1 * | 4/2007 | Channabasappa | 343/700 MS |

FOREIGN PATENT DOCUMENTS

| | | | |
|---|---|---|---|
| JP | 9-148840 | A | 6/1997 |
| JP | 09-237867 | A | 9/1997 |
| JP | 2002-510886 | A | 4/2002 |
| JP | 2002-198852 | A | 7/2002 |
| JP | 2003-215233 | A | 7/2003 |
| JP | 2003-283235 | A | 10/2003 |
| JP | 2004-72358 | A | 3/2004 |
| JP | 2005-191827 | A | 7/2005 |
| WO | WO-99/50929 | A1 | 10/1999 |
| WO | WO 2004/017460 | A1 | 2/2004 |

* cited by examiner

*Primary Examiner* — Douglas W Owens
*Assistant Examiner* — Chuc D Tran
(74) *Attorney, Agent, or Firm* — Birch, Stewart, Kolasch & Birch, LLP

(57) ABSTRACT

A wireless communication device includes: a high frequency circuit for generating a high frequency signal, the high frequency circuit being provided on a high-frequency-circuit surface of an integrated antenna module substrate mounted on a mounting substrate; a patch antenna for irradiating radio waves indicative of the generated high frequency signal, the patch antenna being provided on an antenna surface of the integrated antenna module substrate; and a ring-shaped grounding surface provided on the antenna surface of the integrated antenna module substrate so as to surround the patch antenna. This allows reducing surface waves irradiated from the end of the integrated antenna module substrate and improving antenna characteristics.

15 Claims, 9 Drawing Sheets

WIRELESS COMMUNICATION DEVICE

This non-provisional application claims priority under 35 U.S.C. §119(a) on Patent Application No. 251754/2006 filed in Japan on Sep. 15, 2006, the entire contents of which are hereby incorporated by reference.

FIELD OF THE INVENTION

The present invention relates to a wireless communication device. In particular, the present invention relates to a microwave/millimetric wave wireless communication device having an antenna function.

BACKGROUND OF THE INVENTION

Recently, as communications systems have developed, much notice is paid to wireless transmission of Hi-Vision image signals. High-Vision image signals must transmit large amount of information and accordingly wireless transmission devices using millimetric waves that assure wide band have been developed.

A wireless transmission device includes, for example, a high frequency circuit for converting a transmission signal into a high frequency signal; and an antenna for transmitting the high frequency signal as radio waves to an opposite communication device.

However, in a case of a wireless transmission device using millimetric waves, separately providing a high frequency circuit and an antenna and connecting them cause such a problem that electricity is lost greatly at a point where the high frequency circuit and the antenna are connected with each other.

In order to reduce the loss of electricity at the point where the high frequency circuit and the antenna are connected with each other, integrated antenna modules have been developed. An integrated antenna module contains a high frequency circuit and an antenna in one module.

An example of the integrated antenna modules is disclosed in Japanese Unexamined Patent Publication No. 237867-1997 (Tokukaihei 9-237867; published on Sep. 9, 1997) (hereinafter referred to as Document 1). This integrated antenna module is explained below with reference to FIG. 9.

FIG. 9 is a cross sectional drawing illustrating a structure of a conventional integrated antenna module.

As shown in FIG. 9, the integrated antenna module includes: an antenna circuit substrate X in which an antenna element 902 and a high frequency line 903 for supplying a current to the antenna element 902 are formed on a first dielectric substrate 901; and a high frequency substrate Y in which a high frequency device 906 is contained in a cavity 905 formed in a part of a second dielectric substrate 904 and the high frequency device 906 is sealed by a lid member 907, and a transmission line 908 for transmitting a signal to the high frequency device 906 is formed. The antenna circuit substrate X and the high frequency substrate Y are integrally laminated. Further, the antenna circuit substrate X and the high frequency substrate Y include, as their internal layers, a grand layer 909 and a grand layer 910, respectively.

However, in Document 1, although much of high frequency signals generated by a high frequency circuit are irradiated as radio waves from the antenna element 902, a part of the high frequency signals is propagated as surface waves on a surface of the antenna circuit substrate X where the antenna element 902 is mounted, and the surface waves are irradiated from ends of the antenna circuit substrate X.

Consequently, as the size of the integrated antenna module is made smaller for reducing costs, surface waves irradiated from the ends of the antenna circuit substrate X increase. As a result, a radiation pattern of radio waves irradiated upward from the antenna element 902 is influenced by the surface waves and the radiation pattern is changed.

In the worst case, the antenna element 902 has very low antenna gain at an area above the antenna element 902. Consequently, if the antenna element 902 has, at the area above it, a radiation angle at which antenna gain is very low, a little difference in an angle at which the wireless communication device is positioned may make communications disabled.

SUMMARY OF THE INVENTION

The present invention was made in view of the foregoing problems. An object of the present invention is to provide a wireless communication device capable of reducing surface waves irradiated from ends of an integrated antenna module substrate, thereby improving antenna characteristics.

In order to solve the foregoing problems, a wireless communication device of the present invention includes: a high frequency circuit for generating a high frequency signal, the high frequency circuit being provided on one surface of an integrated antenna module substrate mounted on a mounting substrate; a patch antenna for irradiating radio waves indicative of the generated high frequency signal, the patch antenna being provided on the other surface of the integrated antenna module substrate; and a ring-shaped grounding section provided on the other surface of the integrated antenna module substrate so as to surround the patch antenna.

With the arrangement, the ring-shaped grounding section is provided on the other surface of the integrated antenna module substrate so as to surround the patch antenna. Consequently, when surface waves that are generated from the patch antenna and propagate on the surface of the integrated antenna module substrate reach the ring-shaped grounding section, the surface waves are reflected, decayed, and absorbed by the surface of the ring-shaped grounding section.

Accordingly, due to a shield effect caused by reflection, decay, and absorption on the surface of the ring-shaped grounding section, it is possible to reduce the surface waves. Consequently, it is possible to reduce the surface waves irradiated from the ends of the integrated antenna module substrate.

Consequently, it is possible for the patch antenna to have a maximum gain in a direction upward from the patch antenna, and to have an antenna radiation pattern that does not have a null point above the patch antenna. Therefore, it is possible to increase antenna characteristics of the wireless communication device.

As described above, with the wireless communication device of the present invention, it is possible to reduce surface waves irradiated from the ends of the integrated antenna module substrate and to improve antenna characteristics. Further, because the antenna characteristics are improved, it is easy to set an antenna radiation angle of the wireless communication device.

For a fuller understanding of the nature and advantages of the invention, reference should be made to the ensuing detailed description taken in conjunction with the accompanying drawings.

BRIEF DESCRIPTION OF THE DRAWINGS

FIG. 6(*b*) is a circuit configuration illustrating an LC circuit of the cycle structures of the wireless communication device.

DESCRIPTION OF THE EMBODIMENTS

Embodiment 1

With reference to drawings, the following explains an embodiment of the present invention.

Figure 1:
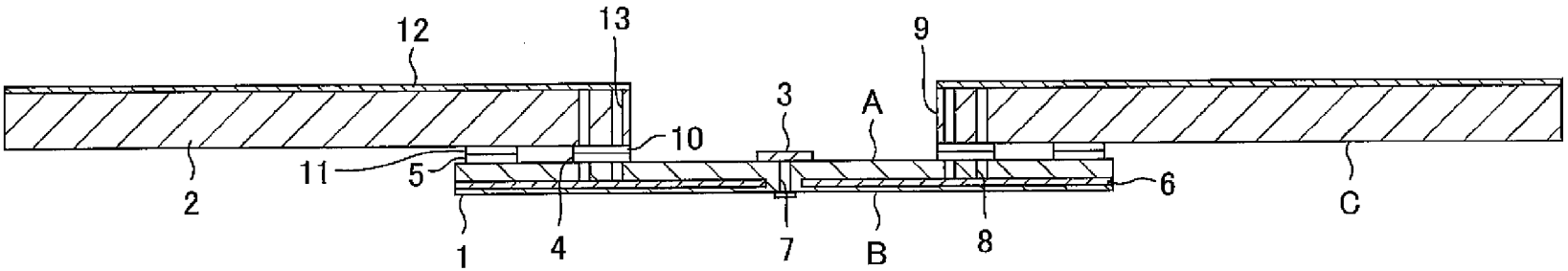
FIG. 1 is a cross sectional drawing illustrating an embodiment of a wireless communication device of the present invention.

FIG. 1 is a cross sectional drawing illustrating an example of a structure of a wireless communication device of the present embodiment.

Figure 2:
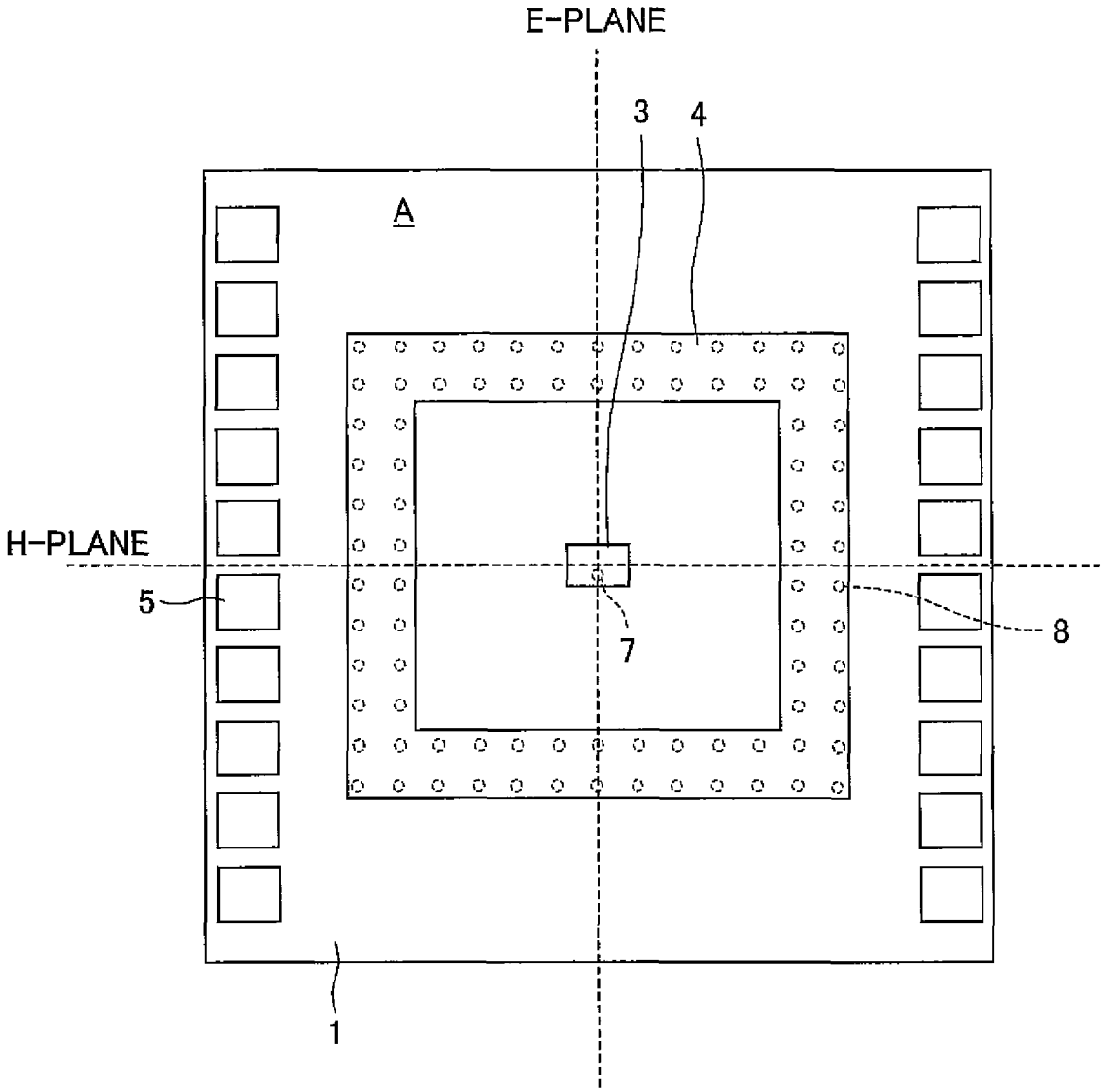
FIG. 2 is a plane drawing illustrating an integrated antenna module of the wireless communication device when seen from a direction perpendicular to a surface where a patch antenna is mounted.

FIG. 2 is a drawing illustrating a structure of only an integrated antenna module substrate 1 of the wireless communication device in FIG. 1, when seen from a direction perpendicular to an antenna surface A where a patch antenna 3 is mounted.

Note that, detailed explanations of generation of high frequency signals and a circuit for generating high frequency signals are omitted in the present invention because an object of the present invention is improvement in antenna characteristics. Further, other parts (not shown) of the wireless communication device can be realized with conventional techniques.

An example of the wireless communication device of the present embodiment is a device for wirelessly transmitting Hi-Vision image signals. Microwaves and millimetric waves etc. are preferably used for transmission band. However, the transmission band of the present embodiment is not limited to them. Alternatively, radio waves whose wavelength is other than those of the microwaves and millimetric waves may be used. Hereinafter, high frequency signal waves irradiated from the wireless communication device are generically referred to as radio waves.

As illustrated in FIG. 1, the wireless communication device of the present embodiment includes an integrated antenna module substrate 1 and a mounting substrate 2. The integrated antenna module substrate 1 and the mounting substrate 2 are contained in a main body (not shown).

First, the following explains a structure of the integrated antenna module substrate 1.

The integrated antenna module substrate 1 is made of a multi-layered low-temperature sintered ceramic substrate, and has a plate shape.

The integrated antenna module substrate 1 is made by integrating an antenna and a high frequency circuit (not shown) including a transmission line and a semiconductor integrated circuit on the substrate. A surface on which a patch antenna 3 is formed as the antenna is referred to as an antenna surface A (other surface), and a surface which is opposite to the antenna surface A and on which the high frequency circuit is formed is referred to as a high-frequency-circuit surface B (one surface).

The integrated antenna module substrate 1 includes, on the antenna surface A, the patch antenna 3, a ring-shaped grounding surface 4 (ring-shaped grounding section), and connection terminals 5. Further, the integrated antenna module substrate 1 includes, as an internal layer between the antenna surface A and the high-frequency-circuit surface B, an internal layer bottom board 6 which is parallel to the antenna surface A and the high-frequency-circuit surface B.

Further, the integrated antenna module substrate 1 includes: a through-hole 7 which extends from the patch antenna 3 to the high frequency circuit on the back surface; and through-holes 8 (first through-holes) which extend from the ring-shaped grounding surface 4 to the internal layer bottom board 6.

The patch antenna 3 has a plate shape whose surface is a rectangular. The shape of the surface of the patch antenna 3 is not limited to a rectangular. The shape may be a circle, an ellipse, or other shape. That is, the shape may be anything as long as the shape allows the patch antenna 3 to have impedance matching with a feeding line and allows the patch antenna 3 to serve as an antenna.

As illustrated in FIG. 2, the patch antenna 3 is provided on the center of the antenna surface A of the integrated antenna module substrate 1 so that the end face of the patch antenna 3 is parallel to ends of the substrate. However, the patch antenna 3 is not necessarily provided on the center of the antenna surface A. The patch antenna 3 may be provided on a suitable position in accordance with designing.

The ring-shaped grounding surface 4 has a plate shape whose surface is a hollow rectangular. The ring-shaped grounding surface 4 is provided on the antenna surface A of the integrated antenna module substrate 1 so as to surround the patch antenna 3 with a predetermined interval from the patch antenna 3. It is desirable that the predetermined interval is not less than approximately $\frac{1}{2}\lambda$ with respect to a frequency of radio waves irradiated from the path antenna 3.

To be specific, as illustrated in FIG. 2, when the integrated antenna module substrate 1 is seen from a direction perpendicular to the antenna surface A, the patch antenna 3 is segmented crosswise in a direction parallel to the end face of the patch antenna 3 with the center of the patch antenna 3 being the center of the cross. At that time, a plane obtained by segmentation in a longitudinal direction is regarded as an E-plane, and a plane obtained by segmentation in a lateral direction is regarded as a H-plane. At that time, the ring-shaped grounding surface 4 is provided on the antenna surface A so as to be plane-symmetrical with respect to the E-plane and H-plane.

Each of the connection terminals 5 has a plate shape whose surface is a square. The connection terminals 5 are provided on the antenna surface A of the integrated antenna module substrate 1 so as to be on sides of two ends of the substrate which ends face each other with the E-plane therebetween.

Ten connection terminals 5 are provided for each end of the substrate so as to form a line parallel to the end of the substrate.

The number and the position of the connection terminals 5 are not limited to the above. The number and the position may be changed in accordance with the length of the end of the substrate, as long as the number and the position allow the integrated antenna module substrate 1 to be mounted on the mounting substrate 2 with sufficient strength.

The internal layer bottom board 6 is formed by lamination between the antenna surface A and the high-frequency-circuit surface B so as to be parallel to the antenna surface A and the high-frequency-circuit surface B. An opening is formed in the internal layer bottom board 6 so as to be an area where the through-hole 7 is to be formed, thereby avoiding the through-hole 7. Further, the internal layer bottom board 6 is connected with GND.

The through-hole 7 is formed right under the patch antenna 3. Consequently, the patch antenna 3 is connected with the high frequency circuit on the opposite surface via the through-hole 7.

The through-holes 8 are formed right under the ring-shaped grounding surface 4. Two lines of the through-holes 8 are formed for each side of the ring-shaped grounding surface 4. Consequently, the ring-shaped grounding surface 4 is connected with the internal layer bottom board 6 via the through-holes 8.

It is desirable that the through-holes 8 are provided as many as possible. For example, when the through-holes 8 are formed with an interval of not more than ⅛ of in-substrate wavelength of radio waves irradiated from the patch antenna 3, an area where the through-holes 8 are formed is substantially equivalent to a metal wall.

The following explains a structure of the mounting substrate 2.

The mounting substrate 2 is made of a glass epoxy print substrate and has a plate shape. The mounting substrate 2 is a substrate on which members provided for the wireless communication device are mounted. The mounting substrate 2 has, at the center of its mounting area, a penetrating hole 9 (penetrating section). The penetrating hole 9 is penetrated by an area which faces a rectangular area surrounded by the ring-shaped grounding surface 4 of the integrated antenna module substrate 1 and which has the same rectangular shape.

The mounting substrate 2 has a grounding surface 10 (grounding section) and connection terminals 11 on a surface where the integrated antenna module substrate 1 is to be mounted. This surface is hereinafter referred to as an antenna-mounting surface C (mounting surface). On the other hand, a metal surface 12 is provided on the surface opposite to the antenna-mounting surface C. Further, the mounting substrate 2 has through-holes 13 (second through-holes) which extend from the grounding surface 10 to the metal surface 12 opposite to the grounding surface 10.

As with the ring-shaped grounding surface 4, the grounding surface 10 has a plate shape whose surface is a hollow rectangular. Further, the grounding surface 10 is provided along a periphery of the penetrating hole 9 of the mounting substrate 2.

Each of the connection terminals 11 has a plate shape whose surface is a square. The connection terminals 11 are provided so that, when the grounding surface 10 of the mounting substrate 2 and the ring-shaped grounding surface 4 of the integrated antenna module substrate 1 face each other and are attached to each other, the position and the number of the connection terminals 11 correspond to those of the connection terminals 5 of the integrated antenna module substrate 1.

The metal surface 12 is formed so as to cover the whole surface opposite to the antenna-mounting surface C.

The through-holes 13 are provided right under the grounding surface 10. Two lines of the through-holes 13 are provided for each side of the grounding surface 10. Consequently, the grounding surface 10 is connected with the metal surface 12 via the through-holes 13.

In the above structure, the integrated antenna module substrate 1 and the mounting substrate 2 are integrally laminated with each other so that the antenna surface A and the antenna-mounting surface C face each other, the ring-shaped grounding surface 4 and the grounding surface 10 correspond to each other, and the connection terminals 5 and the connection terminals 11 correspond to each other. The ring-shaped grounding surface 4 and the grounding surface 10 are connected with each other via solder, and the connection terminals 5 and the connection terminals 11 are connected with each other via solder.

Further, as the mounting substrate 2 has the penetrating hole 9, when the integrated antenna module substrate 1 is integrally laminated with the mounting substrate 2, there is no obstacle above the patch antenna 3 of the integrated antenna module substrate 1 (in a direction in which the penetrating hole 9 is penetrated). Therefore, radio waves irradiated from the patch antenna 3 pass through the penetrating hole 9 of the mounting substrate 2. Consequently, the patch antenna 3 can irradiate radio waves without any problems.

The following explains a transmission operation of the wireless communication device.

First, when a transmission signal is input to the high frequency circuit, the high frequency circuit generates a high frequency signal. The generated high frequency signal is transmitted to the patch antenna 3 from the high frequency circuit via the through-hole 7. Thereafter, radio waves indicative of the high frequency signal are irradiated from the patch antenna 3.

Much of the radio waves irradiated from the patch antenna 3 are irradiated to a space via the penetrating hole 9 of the mounting substrate 2. However, a part of the radio waves becomes surface waves that propagate the antenna surface A of the integrated antenna module substrate 1.

When the surface waves propagate toward the ends of the substrate from the patch antenna 3, the surface waves reach the ring-shaped grounding surface 4 before reaching the ends of the substrate, because the ring-shaped grounding surface 4 is provided so as to surround the patch antenna 3.

At that time, the surface waves are reflected, decayed, and absorbed by the surface of the ring-shaped grounding surface 4. That is, the ring-shaped grounding surface 4 serves as a metal wall for shielding. Consequently, surface waves in a direction parallel to the antenna surface A are reduced due to a shield effect.

Consequently, surface waves propagating toward the ends of the substrate in a direction parallel to the antenna surface A are reduced. Accordingly, it is possible to reduce irradiation of the surface waves from the ends of the integrated antenna module substrate 1.

Consequently, unnecessary antenna gain in a lateral direction from the patch antenna 3 is reduced, while the antenna gain becomes maximum in a direction in which the penetrating hole 9 is penetrated from the patch antenna 3. Therefore, it is possible to have an antenna radiation pattern which does not have a null point in a direction in which the penetrating hole 9 is penetrated from the patch antenna 3.

As described above, in the wireless communication device of the present embodiment, the integrated antenna module substrate 1 is mounted on the mounting substrate 2 so that the antenna-mounting surface C of the mounting substrate 2 and the antenna surface A of the integrated antenna module substrate 1 face each other, and the integrated antenna module substrate 1 has, on the antenna surface A, the patch antenna 3 and the ring-shaped grounding surface 4 surrounding the patch antenna 3, and has, on the high-frequency-circuit surface B, the high frequency circuit.

As described above, the ring-shaped grounding surface 4 is provided on the antenna surface A of the integrated antenna module substrate 1 so as to surround the patch antenna 3. Accordingly, the surface waves that are generated from the patch antenna 3 and propagate on the antenna surface A of the integrated antenna module substrate 1 reach the ring-shaped grounding surface 4 and are reflected, declined, and absorbed by the surface of the ring-shaped grounding surface 4.

Consequently, it is possible to reduce the surface waves by a shield effect caused by reflection, decline, and absorption on the surface of the ring-shaped grounding surface 4. Consequently, it is possible to reduce the surface waves irradiated from the ends of the integrated antenna module substrate 1.

Therefore, it is possible for the patch antenna 3 to have maximum gain in a direction in which the penetrating hole 9 of the mounting substrate 2 is penetrated from the patch antenna 3. Consequently, it is possible to form an antenna radiation pattern which does not have a null point in a direction in which the penetrating hole 9 is penetrated from the patch antenna 3. Consequently, it is possible to improve antenna characteristics of the wireless communication device.

As described above, with the wireless communication device of the present embodiment, it is possible to reduce the surface waves irradiated from the ends of the integrated antenna module substrate 1 and to improve antenna characteristics.

Further, even when the integrated antenna module substrate 1 is downsized, it is possible to obtain good antenna characteristics. Consequently, it is easy to set an antenna radiation angle of the wireless communication device.

Further, in the wireless communication device of the present embodiment, the ring-shaped grounding surface 4 is connected with the through-holes 8 and the internal layer bottom board 6 to form a border serving as a metal wall. The metal wall serves as a shield against the surface waves that propagate the surface of the integrated antenna module substrate 1.

Further, in the mounting substrate 2, the grounding surface 10, the through-holes 13, and the metal surface 12 are connected with each other. Besides, the ring-shaped grounding surface 4 and the grounding surface 10 are connected with each other. Consequently, the metal surface 12, the through-holes 13, the grounding surface 10, the ring-shaped grounding surface 4, the through-holes 8, and the internal layer bottom board 6 are connected with each other to form a border serving as a metal wall. This metal wall serves as an additional shield against the surface waves that propagate the surface of the integrated antenna module substrate 1.

Consequently, the surface waves that propagate toward the ends of the integrated antenna module substrate 1 in a direction parallel to the antenna surface A are further reduced. Accordingly, it is possible to greatly reduce the surface waves irradiated from the ends of the integrated antenna module substrate 1.

Further, the ring-shaped grounding surface 4 is plane-symmetrical with respect to the E-plane and H-plane. Consequently, the surface waves that are generated from the patch antenna 3 and propagate the surface of the integrated antenna module substrate 1 are reduced at positions that are plane-symmetrical with respect to the E-plane and H-plane.

Thus, the influence of the surface waves on the radiation pattern of radio waves irradiated upward from the patch antenna 3 is reduced plane-symmetrically with respect to the E-plane and H-plane. Consequently, it is possible to make the radiation pattern plane-symmetrical with respect to the E-plane and H-plane.

Further, because the ring-shaped grounding surface 4 is plane-symmetrical with respect to the E-plane and H-plane, the penetrating hole 9 is also plane-symmetrical with respect to the E-plane and H-plane. The radio waves irradiated from the patch antenna 3 pass through the penetrating hole 9 toward a space. Therefore, it is possible to make an antenna radiation pattern of the radio waves plane-symmetrical with respect to the E-plane and H-plane.

An explanation was made above as to a case where a cross section of the ring-shaped grounding surface 4 has a hollow rectangular shape. Alternatively, the cross section of the ring-shaped grounding surface 4 may have other shape. For example, FIG. 3 shows a case where the cross section of the ring-shaped grounding surface has a hollow circular shape.

Figure 3:
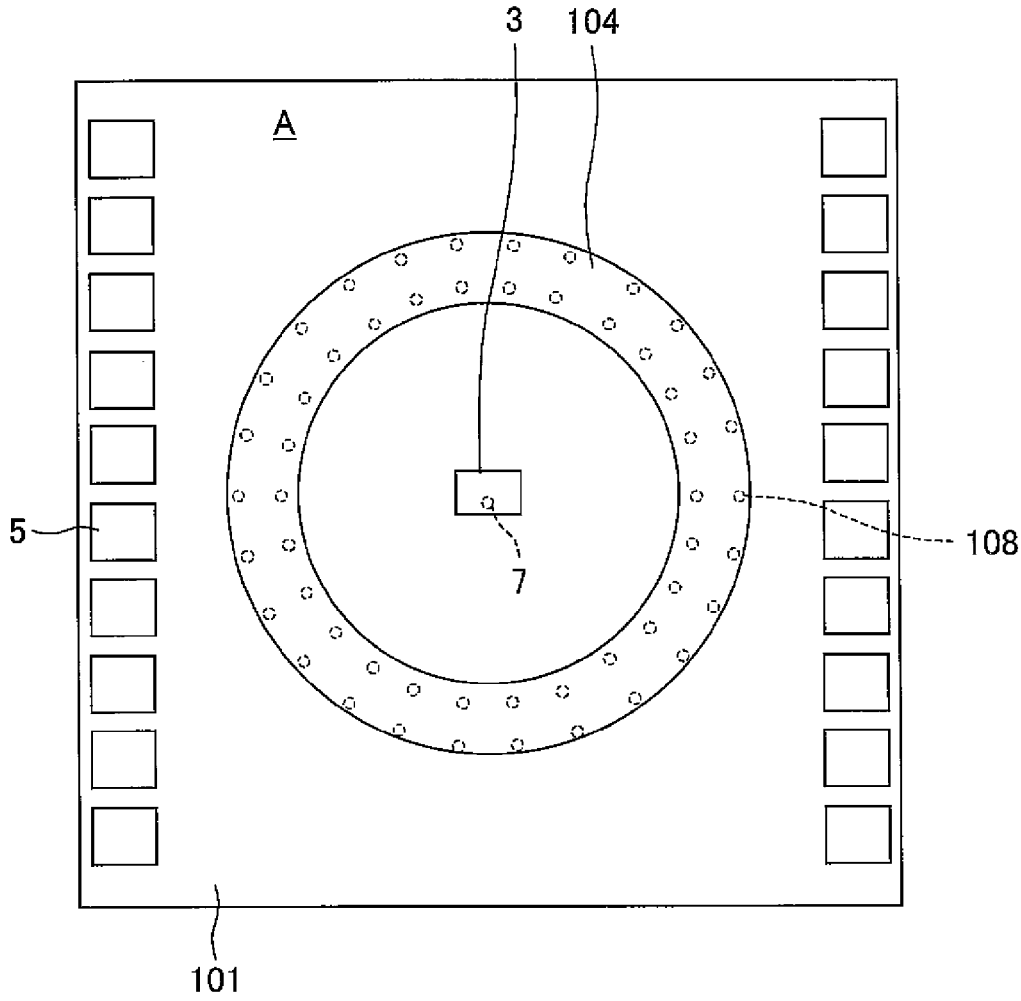
FIG. 3 is a plane drawing illustrating another structure of an integrated antenna module of the wireless communication device when seen from a direction perpendicular to a surface where a patch antenna is mounted.

FIG. 3 is a drawing illustrating a structure of only an integrated antenna module substrate 101 seen from a direction perpendicular to an antenna surface A where the patch antenna 3 is mounted.

The integrated antenna module substrate 101 has a ring-shaped grounding surface 104 (ring-shaped grounding section) instead of the ring-shaped grounding surface 4 of the integrated antenna module substrate 1, and has through-holes 108 (first through-holes) which extend from the ring-shaped grounding surface 104 to the internal layer bottom board 6.

The ring-shaped grounding surface 104 has a flat hollow cylinder shape whose surface is a hollow circle. The ring-shaped grounding surface 104 is provided on the antenna surface A of the integrated antenna module substrate 101 so as to surround the patch antenna 3 with a predetermined interval from the patch antenna 3.

To be specific, the ring-shaped grounding surface 104 is provided on the antenna surface A so that the center of the patch antenna 3 corresponds to the center of the hollow circle in the cross section of the ring-shaped grounding surface 104, when the integrated antenna module substrate 101 is seen from a direction perpendicular to the antenna surface A.

The through-holes 108 are formed right under the ring-shaped grounding surface 104. Two circles (large one and small one) each consists of the through-holes 108 are formed so as to be concentric with the ring-shaped grounding surface 104 having a circular shape. Thus, the ring-shaped grounding surface 104 is connected with the internal layer bottom board 6 via the through-holes 108.

In the integrated antenna module substrate 101 having the above structure, surface waves that are generated from the patch antenna 3 and propagate the surface of the integrated antenna module substrate 101 reach the ring-shaped grounding surface 104. In this case, the ring-shaped grounding surface 104 serves as a shield. Consequently, it is possible to obtain the same effect as that of the wireless communication device having the integrated antenna module substrate 1.

As described above, the cross section of the ring-shaped grounding surface 4 of the integrated antenna module substrate 1 illustrated in FIGS. 1 and 2 may have a hollow rectangular shape illustrated in FIG. 2, a hollow circular shape illustrated in FIG. 3, or a hollow ellipse shape. The cross sectional shape may be determined in accordance with designing of the integrated antenna module substrate 1, such as the size of the integrated antenna module substrate 1, the method for forming the integrated antenna module substrate 1, and the antenna radiation pattern of the integrated antenna module substrate 1.

The shapes of the grounding surface 10 and the penetrating hole 9 of the mounting substrate 2 which face the ring-shaped grounding surface 4 of the integrated antenna module substrate 1 may be determined in accordance with the shape of the ring-shaped grounding surface 4.

Further, an explanation was made above as to a case where the integrated antenna module substrate 1 is made of a multi-layered low-temperature sintered ceramic substrate and the mounting substrate 2 is made of a glass epoxy print substrate. Alternatively, the integrated antenna module substrate 1 may be made of a multi-layered high-temperature sintered ceramic substrate and the mounting substrate 2 is made of a Teflon print substrate.

Further, an explanation was made above as to a case where the wireless communication device carries out a transmission operation. Alternatively, by changing a circuit configuration of the high frequency circuit, it is possible for the wireless communication device to serve as a receiver for carrying out a reception operation.

Embodiment 2

With reference to drawings, the following explains another embodiment of the present invention. Structures other than structures that will be explained in the present embodiment are the same as those in Embodiment 1. For convenience of explanation, members having the same functions as those of members illustrated in the drawings of Embodiment 1 are given the same reference signs and explanations thereof will be omitted here.

Figure 4:
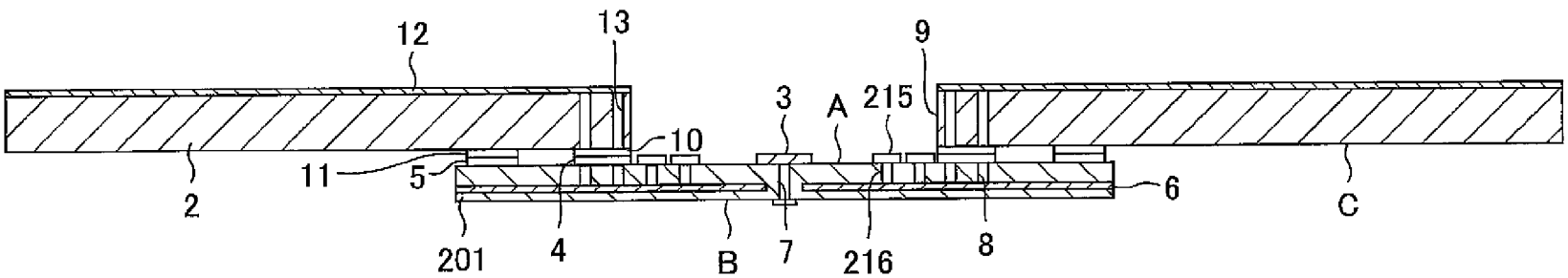
FIG. 4 is a cross sectional drawing illustrating another embodiment of the wireless communication device of the present invention.

FIG. 4 is a cross sectional drawing illustrating an example of a structure of a wireless communication device of the present embodiment.

Figure 5:
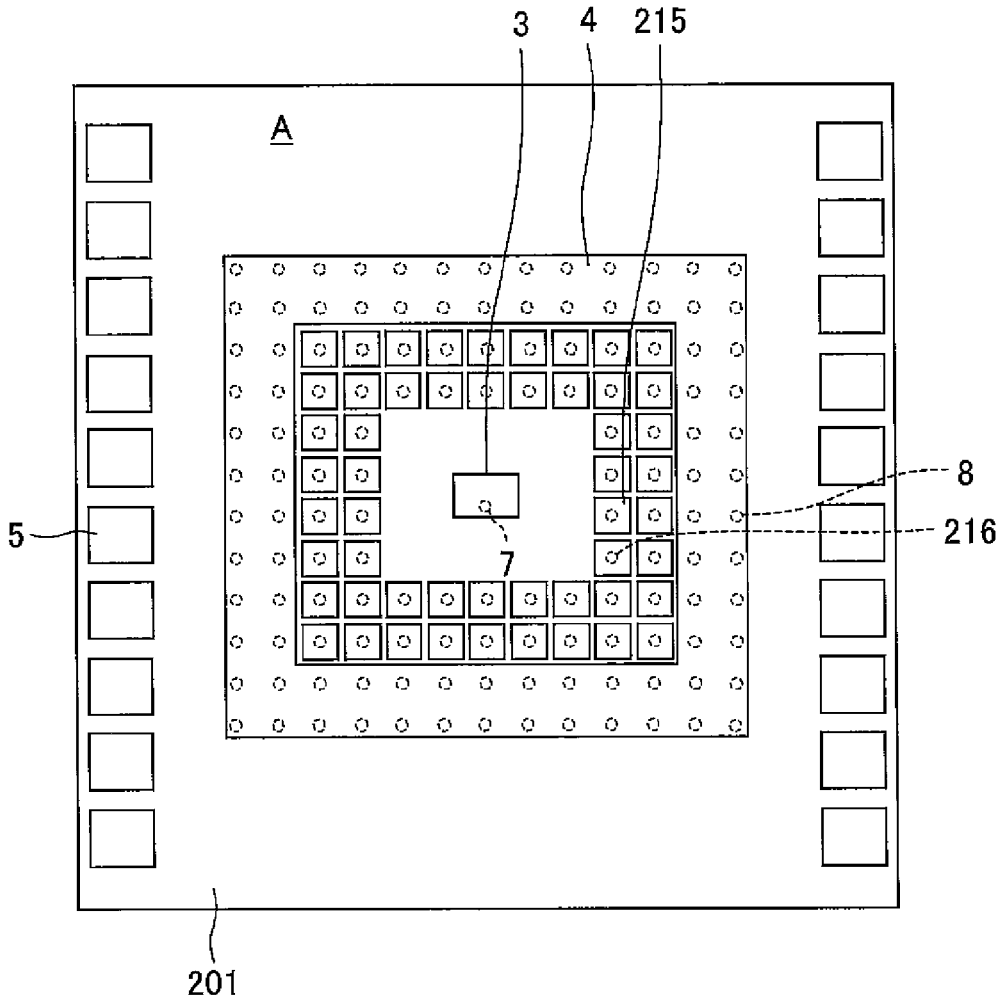
FIG. 5 is a plane drawing illustrating an integrated antenna module of the wireless communication device when seen from a direction perpendicular to a surface where a patch antenna is mounted.

FIG. 5 is a drawing illustrating a structure of only an integrated antenna module substrate 201 of the wireless communication device in FIG. 4, the integrated antenna module substrate 201 being seen from a direction perpendicular to an antenna surface A where a patch antenna 3 is mounted.

The wireless communication device of the present embodiment includes an integrated antenna module substrate 201 and a mounting substrate 2.

The integrated antenna module substrate 201 is obtained by adding, to the integrated antenna module substrate 1 of Embodiment 1, cycle structures 215 on the antenna surface A. Further, the integrated antenna module substrate 201 has through-holes 216 (third through-holes) which extend from the cycle structures 215 to an internal layer bottom board 6.

Each of the cycle structures 215 has a plate shape whose surface is a square. The cycle structures 215 are provided, in a matrix manner, between the patch antenna 3 and the ring-shaped grounding surface 4 on the antenna surface A so as to surround the patch antenna 3.

To be specific, as illustrated in FIG. 5, two lines of the cycle structures 215 are provided for each of four internal sides of the ring-shaped grounding surface 4 with a predetermined interval from the patch antenna 3.

Through-holes 216 are provided right under the cycle structures 215, respectively. Thus, the cycle structures 215 are connected with the internal layer bottom board 6 via the through-holes 216.

In the present embodiment, one unit of the cycle structures 215 is a structure in which an insular conductor pattern is connected with the internal layer bottom board 6 via the through-hole 216. The cycle structures 215 are provided in such a manner that each unit of the cycle structures 215 is provided with a predetermined interval between the units. The predetermined interval is set so that the cycle structures 215 vibrate at or near a desired frequency. The desired frequency is a frequency of radio waves irradiated from the patch antenna 3.

With the arrangement, the cycle structures 215 are provided between the patch antenna 3 and the ring-shaped grounding surface 4. Therefore, when surface waves propagate from the patch antenna 3 toward the ends of the integrated antenna module substrate 201, the surface waves initially reach the cycle structures 215.

At that time, the surface waves pass through an area where the cycle structures 215 are provided, while repeating reflections between the cycle structures 215. Consequently, the surface waves decay gradually due to multiple reflections. Finally, the surface waves decay greatly.

Figure 6:
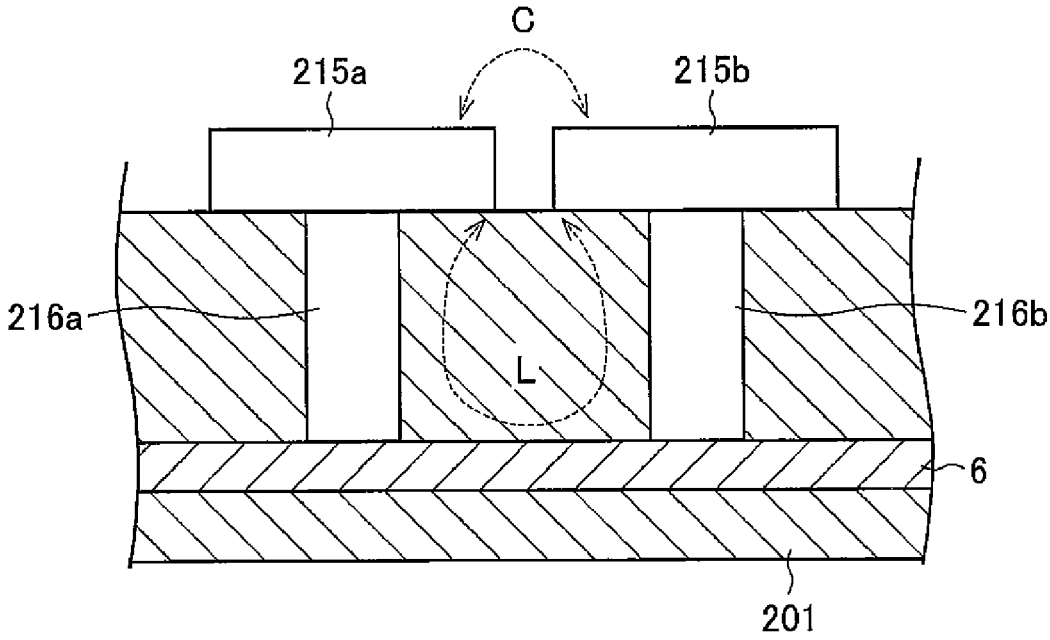
FIG. 6(*a*) is a cross sectional drawing illustrating a structure of cycle structures of the wireless communication device.
Figure 6:
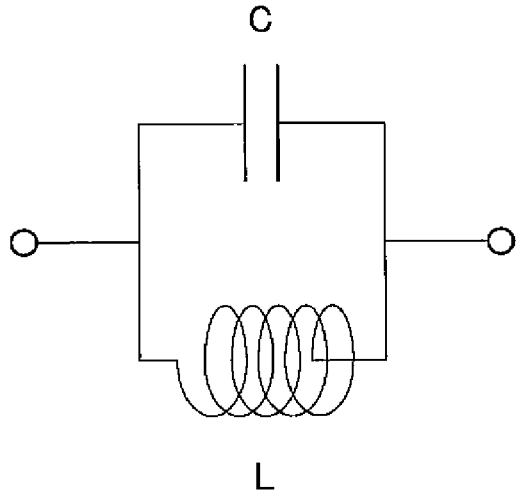

The following details this decay with reference to FIGS. 6(*a*) and 6(*b*).

FIG. 6(*a*) is a cross sectional drawing illustrating two cycle structures 215 (one is referred to as a cycle structure 215*a* and the other is referred to as a cycle structure 215*b*). FIG. 6(*b*) is a circuit diagram illustrating a parallel LC circuit that consists of a capacitor C and an inductor L. Here, a through-hole right under the cycle structure 215*a* is referred to as a through-hole 216*a* and a through-hole right under the cycle structure 215*b* is referred to as a through-hole 216*b*.

When the structure of FIG. 6(*a*) is represented by an equivalent circuit, a gap between insular conductor patterns of the cycle structures 215*a* and 215*b* is the capacitor C. Further, a route from a gap end of the cycle structure 215*a* to a gap end of the cycle structure 215*b* via the through-hole 216*a*, the internal layer bottom board 6, and the through-hole 216*b* serves as the inductor L.

Therefore, as illustrated in FIG. 6(*b*), the structure serves as the parallel LC circuit that consists of the capacitor C and the inductor L. The surface of the integrated antenna module substrate 201 has high impedance at a frequency at which the capacitor C and the inductor L resonate with each other. Consequently, out of surface waves that propagate the integrated antenna module substrate 201, a frequency component at which the capacitor C and the inductor L resonate with each other is most suppressed.

Therefore, by determining the shape and the disposition interval of the cycle structures 215 so that the cycle structures 215 resonate with the frequency of radio waves irradiated from the patch antenna 3, it is possible to most suppress the surface waves propagated from the patch antenna 3.

As described above, the surface waves that propagate toward the ends of the integrated antenna module substrate 201 in a direction parallel to the antenna surface A are further reduced. Accordingly, it is possible to greatly reduce irradiation of the surface waves from the ends of the integrated antenna module substrate 201.

Embodiment 3

With reference to drawings, the following explains further another embodiment of the present invention. Structures other than structures that will be explained in the present embodiment are the same as those in Embodiments 1 and 2. For convenience of explanation, members having the same functions as those of members illustrated in the drawings of Embodiments 1 and 2 are given the same reference signs and explanations thereof will be omitted here.

Figure 7:
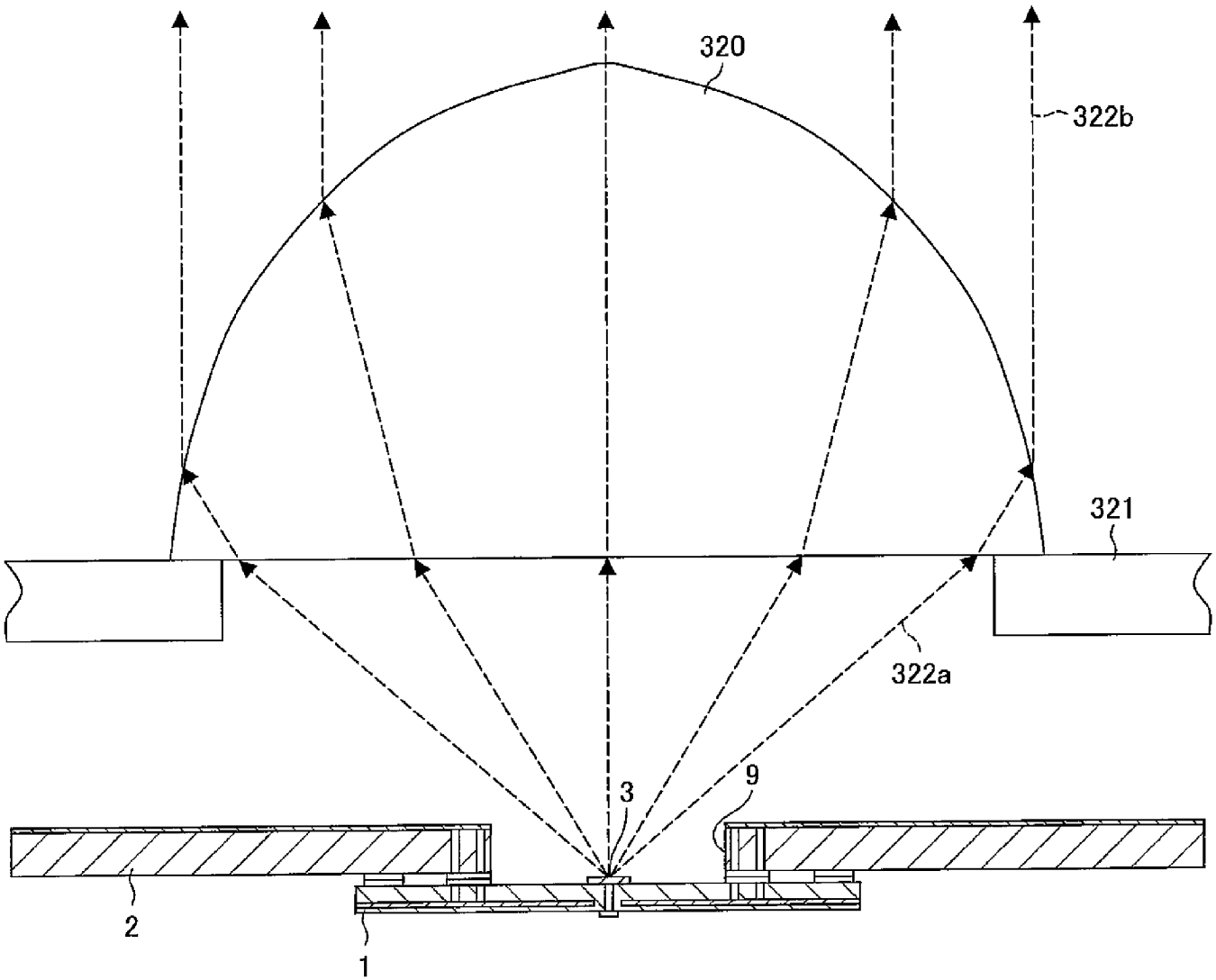
FIG. 7 is a cross sectional drawing illustrating further another embodiment of the wireless communication device of the present invention.

FIG. 7 is a cross sectional drawing illustrating an example of a structure of a wireless communication device of the present embodiment.

The wireless communication device of the present embodiment is obtained by adding, to the wireless communication device of Embodiment 1, a dielectric lens 320 attached to a housing 321.

The dielectric lens 320 is made of high-density polyethylene. The dielectric lens 320 is provided so that the focus of the dielectric lens 320 corresponds to the center of the surface of the patch antenna 3 of the integrated antenna module substrate 1. However, although it is desirable that the center of the patch antenna 3 corresponds to the focus of the dielectric lens 320, it is allowable that the center of the patch antenna 3 is positioned within a converging radius of the dielectric lens 320.

Figure 8:
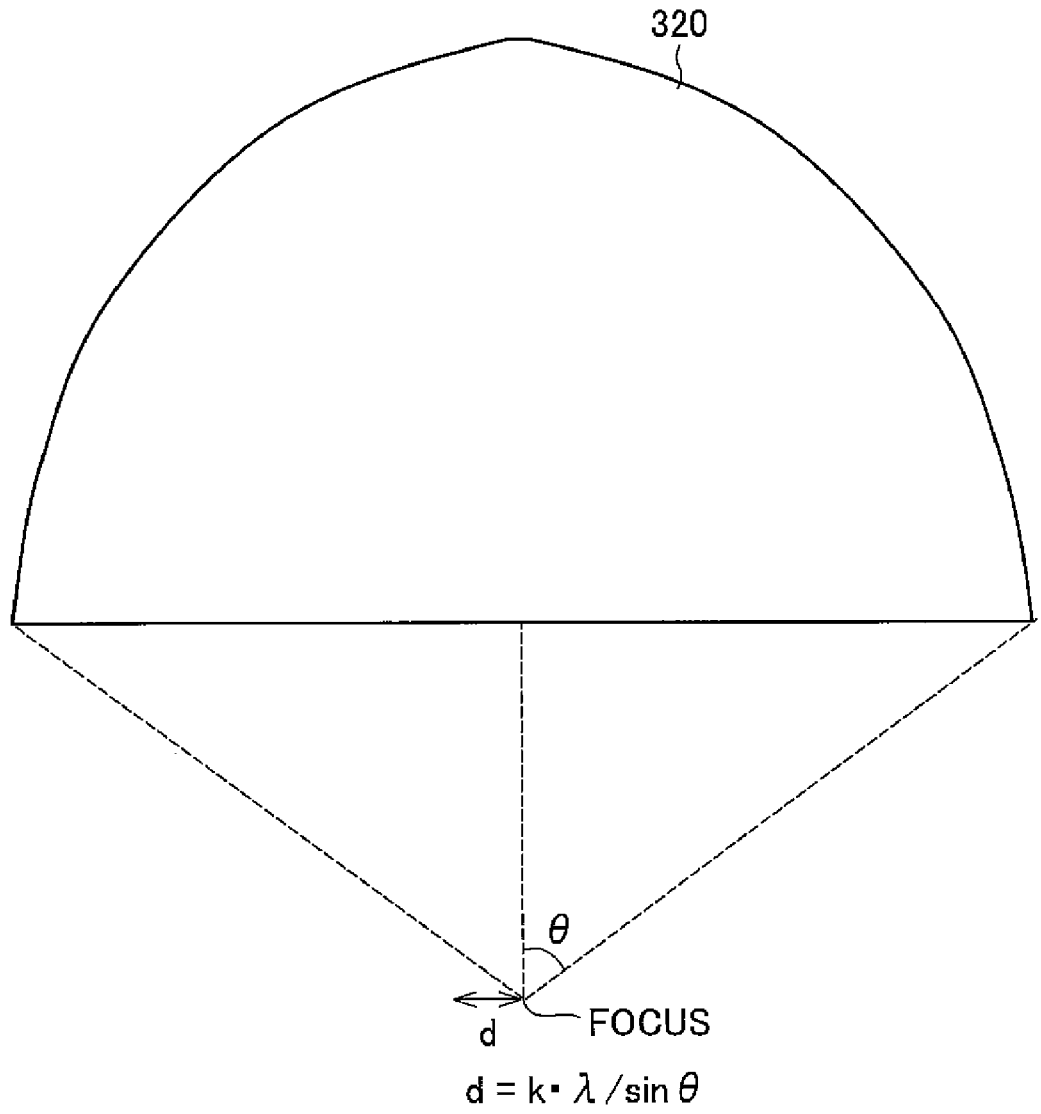
FIG. 8 is a plane drawing illustrating a focus of a dielectric lens of the wireless communication device.
Figure 9:
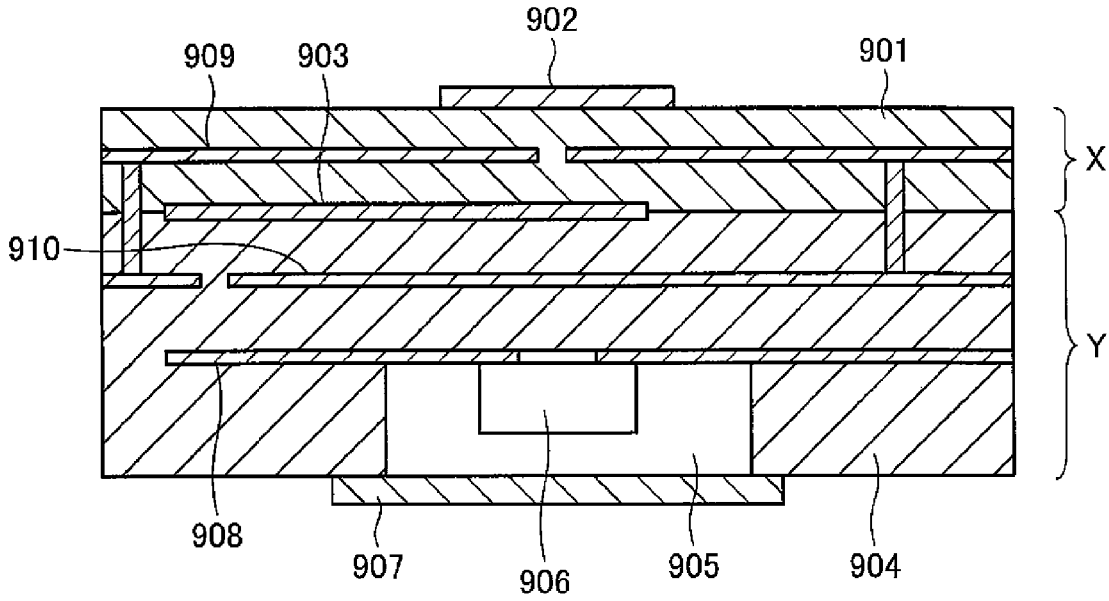
FIG. 9 is a cross sectional drawing illustrating a conventional integrated antenna module substrate.

With reference to FIG. 8, the following explains the converging radius.

FIG. 8 is a plane drawing illustrating the focus of the dielectric lens 320.

A converging radius d is represented by $$d=k\cdot\lambda/\sin\theta$$

where k is a constant and θ is a half of an angle made by seeing an aperture of a lens from a focus.

For example, assume that the radius of the dielectric lens 320 is 15 mm and the focal distance of the dielectric lens 320 is 9 mm. When radio waves of 60 GHz are irradiated, the wavelength of the radio waves is 5 mm. In general, k is approximately 0.6. Accordingly, the converging radius d is approximately 3.5 mm. Therefore, the center of the patch antenna 3 is provided within a circle whose center is the focus of the dielectric lens 320 and whose radius is 3.5 mm.

When radio waves are irradiated from the patch antenna 3, surface waves are suppressed with a mechanism explained above, and radio waves are converged in a direction in which the penetrating hole 9 of the mounting substrate 2 is penetrated from the patch antenna 3. With the above structure, much of the radio waves are incident to the dielectric lens 320.

Here, with reference to FIG. 7, the following explains radio waves 322*a* that are incident to the dielectric lens 320.

At that time, the radio waves 322*a* incident to the dielectric lens 320 are spherical waves. However, the radio waves 322*a* are refracted at an interface between the dielectric lens 320 and the air to be radio waves 322*b* that are plane waves, and the radio waves 322*b* are irradiated from the dielectric lens 320. Consequently, energy directions of the radio waves are aligned. Accordingly, antenna gain is improved.

Further, because much of radio waves irradiated from the patch antenna 3 are incident to the dielectric lens 320, it is possible to realize very high antenna efficiency.

Therefore, it is possible to realize a wireless communication device having antenna characteristics such as high antenna gain and high antenna efficiency.

Further, instead of the integrated antenna module substrate 1, the integrated antenna module substrate 101 in Embodiment 1 or the integrated antenna module substrate 201 in Embodiment 2 may be used.

The present invention is not limited to the above embodiments, and a variety of modifications are possible within the scope of the following claims, and embodiments obtained by combining technical means respectively disclosed in the above embodiments are also within the technical scope of the present invention.

Further, the present invention is particularly effective in realizing a small wireless communication device with high performance. The present invention is applicable to a wireless image transmission device for transmitting Hi-Vision image signals.

As described above, the wireless communication device of the present invention includes: a high frequency circuit for generating a high frequency signal, the high frequency circuit being provided on one surface of an integrated antenna module substrate mounted on a mounting substrate; a patch antenna for irradiating radio waves indicative of the generated high frequency signal, the patch antenna being provided on the other surface of the integrated antenna module substrate; and a ring-shaped grounding section provided on the other surface of the integrated antenna module substrate so as to surround the patch antenna.

Accordingly, the ring-shaped grounding section serves as a shield, and the surface waves that are generated from the patch antenna and propagate on the surface of the integrated antenna module substrate are reduced due to a shield effect. Consequently, it is possible to provide a wireless communication device capable of reducing the surface waves irradiated from the ends of the integrated antenna module substrate, thereby improving antenna characteristics.

Further, it is preferable to arrange the wireless communication device of the present invention so that the integrated antenna module substrate includes, as its internal layer, an internal layer bottom board with which a ground is connected, and the ring-shaped grounding section is connected with the internal layer bottom board via first through-holes.

With the arrangement, the ring-shaped grounding section is connected with the internal layer bottom board via the first through-holes. Consequently, a metal wall is formed by connection of the ring-shaped grounding section, the first through-holes, and the internal layer bottom board, and the metal wall serves as a shield. Accordingly, with a shied effect, it is possible to further reduce the surface waves that are irradiated from the patch antenna and propagate on the surface of the integrated antenna module substrate.

Further, it is preferable to arrange the wireless communication device of the present invention so that the ring-shaped grounding section is plane-symmetrical with respect to an H-plane of the patch antenna when seen from a direction perpendicular to the other surface.

With the arrangement, the ring-shaped grounding section is plane-symmetrical with respect to the H-plane of the patch antenna when seen from a direction perpendicular to the other surface of the integrated antenna module substrate. Accordingly, the surface waves that are generated from the patch antenna and propagate on the surface of the integrated antenna module substrate are reduced at positions that are plane-symmetrical with respect to the H-plane. Thus, the influence of the surface waves on the radiation pattern of radio waves irradiated upward from the patch antenna is reduced plane-symmetrically with respect to the H-plane. Consequently, it is possible to make the radiation pattern plane-symmetrical with respect to the H-plane.

Further, it is preferable to arrange the wireless communication device of the present invention so that the ring-shaped grounding section is plane-symmetrical with respect to an E-plane of the patch antenna when seen from a direction perpendicular to the other surface.

With the arrangement, the ring-shaped grounding section is plane-symmetrical with respect to the E-plane of the patch antenna when seen from a direction perpendicular to the other surface of the integrated antenna module substrate. Accordingly, the surface waves that are generated from the patch antenna and propagate on the surface of the integrated antenna module substrate are reduced at positions that are plane-symmetrical with respect to the E-plane. Thus, the influence of the surface waves on the irradiation pattern of radio waves irradiated upward from the patch antenna is reduced plane-symmetrically with respect to the E-plane. Consequently, it is possible to make the radiation pattern plane-symmetrical with respect to the E-plane.

Further, it is preferable to arrange the wireless communication device of the present invention so that the integrated antenna module substrate is mounted on the mounting substrate so that the other surface faces the mounting substrate, and the mounting substrate has a penetrating section where an area facing an area surrounded by the ring-shaped grounding section is penetrated.

With the arrangement, the integrated antenna module substrate is mounted on the mounting substrate so that the other surface faces the mounting substrate. Accordingly, the patch antenna faces the mounting substrate. The mounting substrate has penetrating section where the area facing the area surrounded by the ring-shaped grounding section is penetrated. Accordingly, the radio waves irradiated from the patch antenna are allowed to pass through the penetrating section of the mounting substrate and to be irradiated out of the wireless communication device without problems.

Further, it is preferable to arrange the wireless communication device of the present invention so that the mounting substrate has a grounding section whose shape is identical with a grounding surface of the ring-shaped grounding section, the grounding section being provided on the mounting substrate so as to be on a surface where the integrated antenna module substrate is mounted and so as to surround the penetrating section, and the ring-shaped grounding section is attached to the grounding section.

With the arrangement, the mounting substrate has a grounding section whose shape is identical with a grounding surface of the ring-shaped grounding section, the grounding section being provided on the mounting substrate so as to be on a surface where the integrated antenna module substrate is mounted and so as to surround the penetrating section, and the ring-shaped grounding section is attached to the grounding section. Consequently, a metal wall is formed by connection of the grounding section and the ring-shaped grounding section, or connection of the grounding section, the ring-shaped grounding section, the first through-holes, and the internal layer bottom board. The metal wall serves as a shield. Therefore, when the mounting substrate has a shield effect, too, it is possible to further suppress the surface waves that are generated from the patch antenna and propagate on the surface of the integrated antenna module substrate.

Further, it is preferable to arrange the wireless communication device of the present invention so that the mounting substrate has a metal surface on a surface opposite to the surface where the integrated antenna module substrate is mounted, and the grounding section is connected with the metal surface via second through-holes.

With the arrangement, the grounding section is connected with the metal surface via the second through-holes. The grounding section is attached to the ring-shaped grounding section. Consequently, a metal wall is formed by connection of the metal surface, second through-holes, the grounding section, and the ring-shaped grounding section, or connection of the metal surface, the second through-holes, the grounding section, the ring-shaped grounding section, the first through-holes, and the internal layer bottom board. The metal wall serves as a shield. Therefore, when the mounting substrate has a shield effect, too, it is possible to further suppress the surface waves that are generated from the patch antenna and propagate on the surface of the integrated antenna module substrate.

Further, it is preferable to arrange the wireless communication device of the present invention so that the integrated antenna module substrate has a plurality of cycle structures that are provided between the patch antenna and the ring-shaped grounding section on the other surface so as to surround the patch antenna.

With the arrangement, the integrated antenna module substrate has a plurality of cycle structures that are provided between the patch antenna and the ring-shaped grounding section on the other surface so as to surround the patch antenna. Consequently, the surface waves that are generated from the patch antenna and propagate on the surface of the integrated antenna module substrate pass through an area where the cycle structures are provided, while repeating reflections between the cycle structures. Accordingly, the surface waves decay gradually. Therefore, it is possible to reduce the surface waves irradiated from the ends of the integrated antenna module substrate.

Further, it is preferable to arrange the wireless communication device of the present invention so that each of the cycle structures has a structure in which an insular metal pattern is connected with the internal layer bottom board via a third through-hole.

With the arrangement, each of the cycle structures has a structure in which an insular metal pattern is connected with the internal layer bottom board via a third through-hole. Consequently, the surface of the integrated antenna module substrate is equivalent to an LC circuit consisting of an inductor and a capacitor that are connected with each other in parallel. Accordingly, the surface of the integrated antenna module substrate has high impedance. Consequently, it is possible to further suppress the surface waves that are generated from the patch antenna and propagate on the surface of the integrated antenna module substrate.

It is preferable to arrange the wireless communication device of the present invention so that an interval between two adjacent cycle structures of the cycle structures is set so that each of the cycle structures resonates at a frequency of the radio waves irradiated from the patch antenna.

When the surface of the integrated antenna module circuit is equivalent to the LC circuit consisting of the inductor and the capacitor that are connected with each other in parallel, the surface of the integrated antenna module substrate has maximum impedance at a frequency of the radio waves irradiated from the patch antenna.

With the arrangement, the interval between two adjacent cycle structures of the cycle structures is set so that each of the cycle structures resonates at a frequency of the radio waves irradiated from the patch antenna. Consequently, it is possible to further reduce the surface waves that propagate toward the ends of the integrated antenna module substrate in a direction parallel to the antenna surface. Accordingly, it is possible to greatly reduce irradiation of the surface waves from the ends of the integrated antenna module substrate.

Further, it is preferable to arrange the wireless communication device of the present invention so as to further include a dielectric lens for receiving the radio waves irradiated from the patch antenna and for irradiating the received radio waves, the dielectric lens being provided so that a focus of the dielectric lens corresponds to a center of the patch antenna.

With the arrangement, the radio waves that are spherical waves when irradiated from the patch antenna are incident to and refracted by the dielectric lens, so that the radio waves are irradiated from the dielectric lens as plane waves. Consequently, radiation directions are aligned and energies are converged to be strong, resulting in improvement in antenna gain.

Further, because the surface waves are suppressed, much of the radio waves irradiated from the patch antenna are incident to the dielectric lens. Accordingly, it is possible to realize very high antenna efficiency.

Consequently, it is possible to realize a wireless communication device having antenna characteristics such as high antenna gain and high antenna efficiency.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A wireless communication device, comprising:

a high frequency circuit for generating a high frequency signal, the high frequency circuit being provided on one surface of an integrated antenna module substrate mounted on a mounting substrate;

a patch antenna for irradiating radio waves indicative of the generated high frequency signal, the patch antenna being provided on the other surface of the integrated antenna module substrate; and a ring-shaped grounding section provided on the other surface of the integrated antenna module substrate so as to surround the patch antenna, wherein the integrated antenna module substrate includes (i) a through-hole extending from a position directly under the patch antenna to the high frequency circuit and (ii) a plurality of first through-holes formed right under the ring-shaped grounding section, and the plurality of first through-holes is formed with an interval of not more than ⅛ of in-substrate wavelength of the radio waves irradiated from the patch antenna.

2. The wireless communication device as set forth in claim 1, wherein the integrated antenna module substrate includes, as its internal layer, an internal layer bottom board with which a ground is connected, and the ring-shaped grounding section is connected with the internal layer bottom board via the plurality of first through-holes.

3. The wireless communication device as set forth in claim 2, wherein the ring-shaped grounding section is plane-symmetrical with respect to an H-plane of the patch antenna when seen from a direction perpendicular to the other surface.

4. The wireless communication device as set forth in claim 2, wherein the ring-shaped grounding section is plane-symmetrical with respect to an E-plane of the patch antenna when seen from a direction perpendicular to the other surface.

5. The wireless communication device as set forth in claim 2, wherein the integrated antenna module substrate is mounted on the mounting substrate so that the other surface faces the mounting substrate, and the mounting substrate has a penetrating section where an area facing an area surrounded by the ring-shaped grounding section is penetrated.

6. The wireless communication device as set forth in claim 5, wherein the mounting substrate has a grounding section whose shape is identical with a grounding surface of the ring-shaped grounding section, the grounding section being provided on the mounting substrate so as to be on a surface where the integrated antenna module substrate is mounted and so as to surround the penetrating section, and the ring-shaped grounding section is attached to the grounding section.

7. The wireless communication device as set forth in claim 6, wherein the mounting substrate has a metal surface on a surface opposite to the surface where the integrated antenna module substrate is mounted, and the grounding section is connected with the metal surface via second through-holes.

8. The wireless communication device as set forth in claim 1, wherein the integrated antenna module substrate is mounted on the mounting substrate so that the other surface faces the mounting substrate, and the mounting substrate has a penetrating section where an area facing an area surrounded by the ring-shaped grounding section is penetrated.

9. The wireless communication device as set forth in claim 8, wherein the mounting substrate has a grounding section whose shape is identical with a grounding surface of the ring-shaped grounding section, the grounding section being provided on the mounting substrate so as to be on a surface where the integrated antenna module substrate is mounted and so as to surround the penetrating section, and the ring-shaped grounding section is attached to the grounding section.

10. The wireless communication device as set forth in claim 9, wherein the mounting substrate has a metal surface on a surface opposite to the surface where the integrated antenna module substrate is mounted, and the grounding section is connected with the metal surface via second through-holes.

11. The wireless communication device as set forth in claim 1, further comprising:

a dielectric lens for receiving the radio waves irradiated from the patch antenna and for irradiating the received radio waves, the dielectric lens being provided so that a focus of the dielectric lens corresponds to a center of the patch antenna.

12. A wireless communication device, comprising:

a high frequency circuit for generating a high frequency signal, the high frequency circuit provided on one surface of an integrated antenna module substrate mounted on a mounting substrate;

a patch antenna for irradiating radio waves indicative of the generated high frequency signal, the patch antenna provided on another surface of the integrated antenna module substrate;

a ring-shaped grounding section provided on the another surface of the integrated antenna module substrate so as to surround the patch antenna, wherein the integrated antenna module substrate includes, as its internal layer, an internal layer bottom board with which a ground is connected, the ring-shaped grounding section is connected with the internal layer bottom board via first through-holes, and the integrated antenna module substrate has a plurality of cycle structures that are provided between the patch antenna and the ring-shaped grounding section on the another surface so as to surround the patch antenna.

13. The wireless communication device as set forth in claim 12, wherein each of the cycle structures has a structure in which an insular metal pattern is connected with the internal layer bottom board via a third through-hole.

14. The wireless communication device as set forth in claim 13, wherein an interval between two adjacent cycle structures of the cycle structures is set so that each of the cycle structures resonates at a frequency of the radio waves irradiated from the patch antenna.

15. A wireless communication device, comprising:

a high frequency circuit for generating a high frequency signal, the high frequency circuit being provided on one surface of an integrated antenna module substrate mounted on a mounting substrate;

a patch antenna for irradiating radio waves indicative of the generated high frequency signal, the patch antenna being provided on the other surface of the integrated antenna module substrate; and a ring-shaped grounding section provided on the other surface of the integrated antenna module substrate so as to surround the patch antenna, wherein the ring-shaped grounding section is formed away from end of the integrated antenna module substrate, a gap between the patch antenna and the ring-shaped grounding section is greater than or equal to one half a wavelength of the radio waves irradiated by the patch antenna, and the integrated antenna module substrate includes a plurality of first through-holes formed right under the ring-shaped grounding section, the plurality of first through-holes being formed with an interval of not more than ⅛ of in-substrate wavelength of the radio waves irradiated from the patch antenna.

* * * * *